US011280142B2

(12) United States Patent
Lajesic

(10) Patent No.: US 11,280,142 B2
(45) Date of Patent: Mar. 22, 2022

(54) WELLBORE SEALING SYSTEM WITH DEGRADABLE WHIPSTOCK

(71) Applicant: Halliburton Energy Services, Inc., Houston, TX (US)

(72) Inventor: Borisa Lajesic, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 355 days.

(21) Appl. No.: 15/029,279

(22) PCT Filed: Dec. 15, 2014

(86) PCT No.: PCT/US2014/070282

§ 371 (c)(1),
(2) Date: Apr. 14, 2016

(87) PCT Pub. No.: WO2016/099439

PCT Pub. Date: Jun. 23, 2016

(65) Prior Publication Data

US 2016/0326818 A1 Nov. 10, 2016

(51) Int. Cl.

| | |
|---|---|
| ***E21B 23/01*** | (2006.01) |
| ***E21B 7/06*** | (2006.01) |
| ***E21B 41/00*** | (2006.01) |
| ***E21B 33/12*** | (2006.01) |

(52) U.S. Cl.

CPC ..... *E21B 23/01* (2013.01); *E21B 7/061* (2013.01); *E21B 33/12* (2013.01); *E21B 41/0042* (2013.01)

(58) Field of Classification Search

CPC ..... E21B 23/01; E21B 7/061; E21B 33/12; E21B 41/0042

See application file for complete search history.

(56) References Cited

U.S. PATENT DOCUMENTS 4,182,423 A * 1/1980 Ziebarth ..... E21B 7/061 166/117.5

5,553,671 A 9/1996 Sieber (Continued)

FOREIGN PATENT DOCUMENTS

WO 2009/129116 10/2009

OTHER PUBLICATIONS

International Search Report and Written Opinion, Application No. PCT/US2014/070282; 18 pages.

*Primary Examiner* — Waseem Moorad
*Assistant Examiner* — Neel Girish Patel
(74) *Attorney, Agent, or Firm* — Scott Richardson; Baker Botts L.L.P.

(57) ABSTRACT

A wellbore sealing system is disclosed. The wellbore sealing system includes a deflection assembly positioned in a main wellbore and a junction coupled to an uphole end of the completion deflector and extending into the lateral wellbore to form a fluid and pressure tight seal. The deflection assembly includes a degradable whipstock configured to laterally deflect a drill bit such that the drill bit drills through a sidewall of the main wellbore to form a lateral wellbore, a completion deflector coupled to and located downhole from the whipstock, and an anchoring device coupled to and located downhole from the completion deflector to prevent the deflection assembly from rotating and moving in an uphole direction and a downhole direction within the main wellbore.

24 Claims, 8 Drawing Sheets

(56) References Cited

U.S. PATENT DOCUMENTS

| | | | | |
|---|---|---|---|---|
| 6,015,012 | A * | 1/2000 | Reddick | E21B 7/061 166/117.5 |
| 6,241,021 | B1 | 6/2001 | Bowling | |
| 6,457,525 | B1 | 10/2002 | Scott | |
| 6,880,631 | B1 | 4/2005 | McGarian et al. | |
| 7,353,879 | B2 | 4/2008 | Todd et al. | |
| 7,363,967 | B2 | 4/2008 | Burris et al. | |
| 8,210,270 | B2 | 7/2012 | Renshaw et al. | |
| 8,245,774 | B2 | 8/2012 | Carter et al. | |
| 8,376,066 | B2 | 2/2013 | Steele et al. | |
| 8,485,265 | B2 | 7/2013 | Maiya et al. | |
| 8,567,494 | B2 | 10/2013 | Rytlewski et al. | |
| 8,584,746 | B2 | 11/2013 | Marya et al. | |
| 2003/0213600 | A1* | 11/2003 | Smith | E21B 43/103 166/384 |
| 2004/0159435 | A1 | 8/2004 | Plucheck et al. | |
| 2008/0105438 | A1* | 5/2008 | Jordan | C22C 1/0408 166/376 |
| 2009/0226340 | A1 | 9/2009 | Marya | |
| 2010/0270031 | A1 | 10/2010 | Patel | |
| 2012/0103687 | A1* | 5/2012 | Saurer | E21B 7/061 175/45 |
| 2012/0111636 | A1* | 5/2012 | Steele | E21B 7/061 175/61 |
| 2013/0020084 | A1 | 1/2013 | Goodson | |
| 2013/0020088 | A1 | 1/2013 | Dyer et al. | |
| 2013/0284460 | A1* | 10/2013 | Hallundbæk | E21B 17/023 166/382 |
| 2014/0144652 | A1* | 5/2014 | Steele | E21B 23/03 166/382 |

* cited by examiner

WELLBORE SEALING SYSTEM WITH DEGRADABLE WHIPSTOCK

RELATED APPLICATION

This application is a U.S. National Stage Application of International Application No. PCT/US2014/070282 filed Dec. 15, 2014, which designates the United States, and which is incorporated herein by reference in its entirety.

TECHNICAL FIELD

The present disclosure is related to downhole drilling tools and more particularly to downhole tools used in the drilling of lateral wellbores from main wellbores.

BACKGROUND OF THE DISCLOSURE

A multilateral well may include multiple wellbores drilled off of a main wellbore. Each of the wellbores drilled off the main wellbore may be referred to as a lateral wellbore. Lateral wellbores may be drilled from a main wellbore in order to target multiple zones for purposes of producing hydrocarbons such as oil and gas from subsurface formations. Lateral wellbores may be drilled from a portion of the main wellbore that is substantially vertical (e.g., substantially perpendicular to the surface), substantially horizontal (e.g., substantially parallel to the surface), or at an angle between vertical and horizontal.

BRIEF DESCRIPTION OF THE DRAWINGS

A more complete and thorough understanding of the various embodiments and advantages thereof may be acquired by referring to the following description taken in conjunction with the accompanying drawings, in which like reference numbers indicate like features, and wherein.

DETAILED DESCRIPTION OF THE DISCLOSURE

Embodiments of the present disclosure and its advantages may be understood by referring to FIGS. 1 through 7, where like numbers are used to indicate like and corresponding parts.

To assist with drilling a lateral wellbore, a deflection assembly may be positioned within a main wellbore downhole from a desired intersection with the lateral wellbore. The deflection assembly may include a whipstock, a completion deflector, and an anchoring device. The deflection assembly may be held in place within the main wellbore by the anchoring device, which may engage with a casing string of the main wellbore. A drill bit inserted into the main wellbore may contact the whipstock and be deflected such that it drills through the side-wall of the main wellbore and into the formation to form the lateral wellbore. After the lateral wellbore has been formed, the whipstock may be removed from the main wellbore. To avoid the time and expense associated with inserting a retrieval tool into the main wellbore to extract the whipstock from the main wellbore, the whipstock may be removed by a chemical reaction that causes the whipstock to degrade within the main wellbore. When the whipstock has degraded to the point that the remaining pieces or particles of the whipstock do not impede the flow of fluids or movement of downhole tools within the main wellbore and the lateral wellbore, the completion deflector may be used to position downhole tools within the lateral wellbore. In the absence of the whipstock, a downhole tool of large enough diameter inserted into the main wellbore will contact the completion deflector and be deflected into the lateral wellbore.

Figure 1:
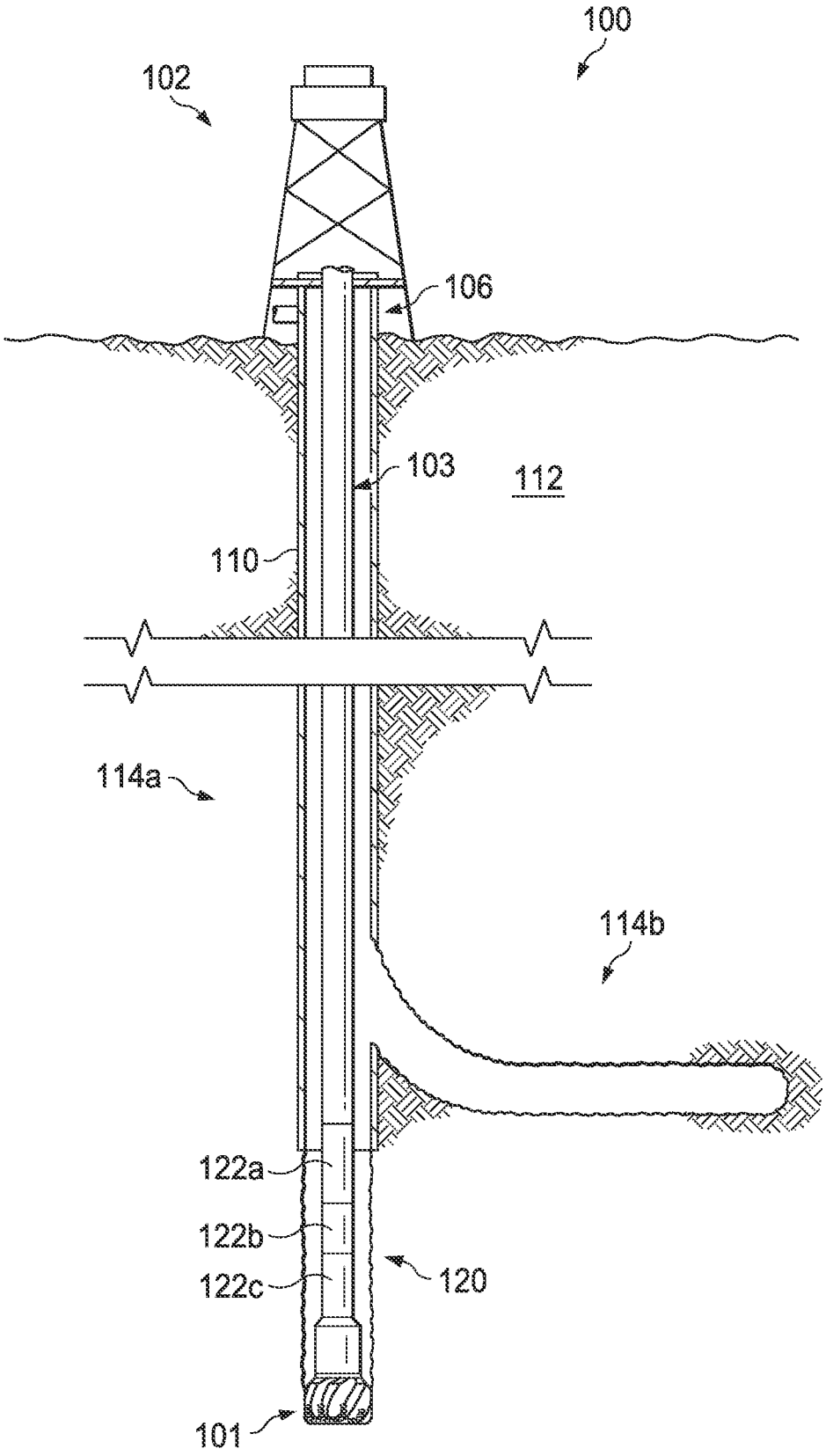
FIG. 1 illustrates an elevation view of a drilling system.

FIG. 1 illustrates an elevation view of an example embodiment of a drilling system. Drilling system 100 may include well surface or well site 106. Various types of drilling equipment such as a rotary table, drilling fluid pumps and drilling fluid tanks (not expressly shown) may be located at well surface or well site 106. For example, well site 106 may include drilling rig 102, which may have various characteristics and features associated with a "land drilling rig." However, downhole drilling tools incorporating teachings of the present disclosure may be satisfactorily used with drilling equipment located on offshore platforms, drill ships, semi-submersibles and drilling barges (not expressly shown).

Drilling system 100 may also include drill string 103 associated with drill bit 101, which may be used to form a wide variety of wellbores or bore holes such as main wellbore 114*a* or lateral wellbore 114*b*. The term "wellbore" may be used to describe any hole drilled into a formation for the purpose of exploration or extraction of natural resources such as, for example, hydrocarbons, or for the purpose of injection of fluids such as, for example, water, wastewater, brine, or water mixed with other fluids. Additionally, the term "wellbore" may be used to describe any hold drilled into a formation for the purpose of geothermal power generation. As shown in FIG. 1, main wellbore 114*a* and lateral wellbore 114*b* may be drilled through earth formation 112. Casing string 110 may be placed in main wellbore 114*a* and held in place by cement, which may be injected between casing string 110 and the sidewalls of main wellbore 114*a*. Casing string 110 may provide radial support to main wellbore 114*a* and may seal against unwanted communication of fluids between main wellbore 114*a* and surrounding formation 112. Casting string 110 may extend from well surface 106 to a selected downhole location within main wellbore 114*a*. Portions of main wellbore 114*a* and lateral wellbore 114*b* that do not include casing string 110 may be described as "open hole."

The terms "uphole" and "downhole" may be used to describe the location of various components relative to the bottom or end of main wellbore 114*a* or lateral wellbore 114*b* shown in FIG. 1. For example, a first component described as uphole from a second component may be further away from the end of main wellbore 114*a* or lateral wellbore 114*b* than the second component. Similarly, a first component described as being downhole from a second component may be located closer to the end of main wellbore 114*a* or lateral wellbore 114*b* than the second component.

Drilling system 100 may also include bottom hole assembly (BHA) 120 coupled to drill string 103. Various directional drilling techniques and associated components of bottom hole assembly (BHA) 120 may be used to form main wellbore 114*a* and lateral wellbore 114*b*. BHA 120 may be formed from a wide variety of components configured to form a wellbore. For example, components 122*a*, 122*b* and 122*c* of BHA 120 may include, but are not limited to, drill bits (e.g., drill bit 101), coring bits, drill collars, rotary steering tools, directional drilling tools, downhole drilling motors, reamers, hole enlargers or stabilizers. The number and types of components 122 included in BHA 120 may depend on anticipated downhole drilling conditions and the type of wellbore that will be formed by drill string 103 and rotary drill bit 101.

Lateral wellbore 114*b* may extend laterally from an intersection with main wellbore 114*a*. To assist with drilling lateral wellbore 114*b*, a deflection assembly (shown in FIG. 2) may be positioned within main wellbore 114*a* at the desired intersection with lateral wellbore 114*b* and used to laterally deflect drill bit 101 such that it drills through the side-wall of main wellbore 114*a* and into formation 112 to form lateral wellbore 14*b*.

Figure 2:
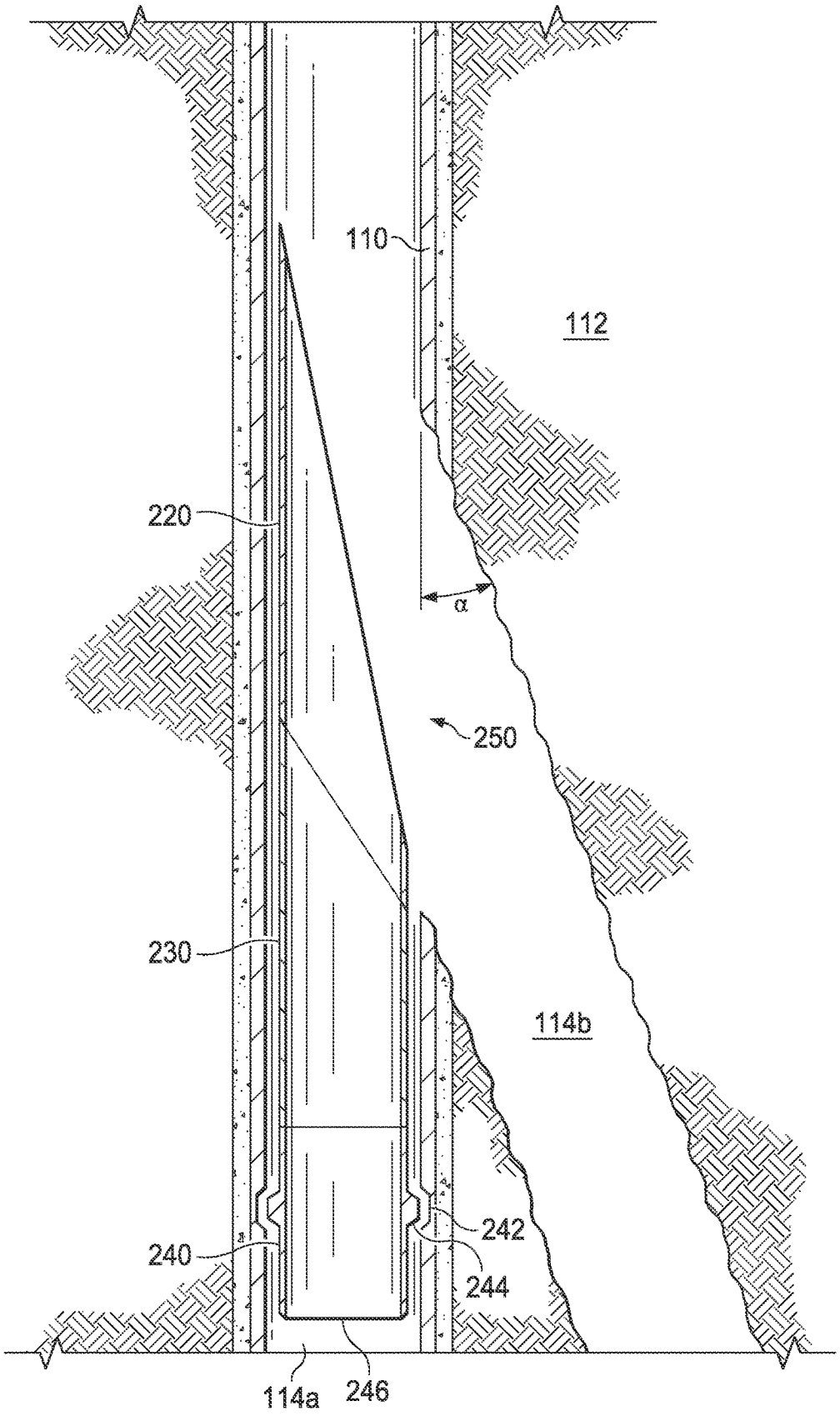
FIG. 2 is a cross-sectional view of a deflection assembly installed in a main wellbore from which a lateral wellbore has been formed.

FIG. 2 is a cross-sectional view of a deflection assembly installed in a main wellbore. Deflection assembly 210 may include whipstock 220, completion deflector 230, and anchoring device 240. Deflection assembly 210 may be positioned in main wellbore 114*a* downhole from a desired intersection with lateral wellbore 114*b* and may be held in place within main wellbore 114*a* by anchoring device 240.

Anchoring device 240 may include spring-loaded latches 244 configured to engage with recesses 242 formed on the interior surface of casing string 110. When deflection assembly 210 is inserted into main wellbore 114*a*, spring-loaded latches 244 may be in contact with casing string 110, which may exert pressure on spring-loaded latches 244 and prevent them from extending radially as deflection assembly 210 is inserted into main wellbore 114*a*. When latches 244 are aligned with recesses 242, latches 244 may no longer be in contact with casing string 110 and spring-loaded latches 244 may extend radially into recesses 242. Engagement of spring-loaded latches 244 into recesses 242 may anchor deflection assembly 210 within casing string 110. For example, engagement of spring-loaded latches 244 into recesses 242 may prevent movement of deflection assembly 210 in the uphole and downhole directions within main wellbore 114*a*. Engagement of spring-loaded latches 244 into recesses 242 may also prevent rotation of deflection assembly 210 within main wellbore 114*a*. Anchoring device 240 may also include channel 246 extending axially through anchoring device 240 to allow production fluids to circulate through anchoring device 240.

Alternatively, the anchoring device may include spring-loaded, serrated dogs configured to engage with the interior surface of a casing string within the main wellbore. When the deflection assembly is inserted into the main wellbore, the serrated dogs may extend radially to engage with the interior surface of the casing string. Engagement of the serrated dogs with casing string 110 may anchor deflection assembly 210 within casing string 110. For example, engagement of the serrated dogs with casing string 110 may prevent movement of deflection assembly 210 in the uphole and downhole directions within main wellbore 114*a*. Engagement of the serrated dogs with casing string 110 may also prevent rotation of deflection assembly 210 within main wellbore 114*a*.

The downhole end of anchoring device 240 may engage with production tubing located downhole from anchoring device 240 to form a fluid and pressure tight seal. Alternatively, the downhole end of anchoring device 240 may engage with a portion of casing string 110 located downhole from anchoring device 240. Anchoring device 240 may engage with a swell packer that engages with both anchoring device 240 and casing string 110 to form a fluid and pressure tight seal.

The uphole end of anchoring device 240 may be coupled to the downhole end of completion deflector 230. In some embodiments, anchoring device 240 may be coupled to completion deflector 230 by a threaded joint. In other embodiments, a different coupling mechanism may be employed. The coupling of anchoring device 240 and completion deflector 230 may also provide a fluid and pressure tight seal. The uphole end of completion deflector 230 may be coupled to the downhole end of whipstock 220. In some embodiments, completion deflector 230 may be coupled to whipstock 220 by a threaded joint. In other embodiments, a different coupling mechanism may be employed.

Once deflection assembly 210 has been anchored within main wellbore 114*a*, deflection assembly 210 may be used to assist with drilling lateral wellbore 114*b*. For example, a drill bit inserted into main wellbore 114*a* may contact whipstock 220 and be deflected laterally into the sidewall of main wellbore 114*a*, causing the drill bit to drill through the sidewall of main wellbore 114*a* and into formation 112 to form lateral wellbore 114*b*. Deflection assembly 210 may be positioned in main wellbore 114*a* such that the drill bit is deflected laterally into the sidewall of main wellbore 114*a* at a particular angle and at a particular elevation within main wellbore 114*a*. The positioning of deflection assembly 210 may be determined based on the desired elevation of lateral wellbore 114*b* within main wellbore 114*a* and the angle $\alpha$ of lateral wellbore 114*b* relative to main wellbore 114*a*.

In some embodiments, the drill bit may be deflected by whipstock 220 through window 250 in casing string 110 such that it drills through the sidewall of main wellbore 114*a* into formation 112 to form lateral wellbore 114*b*. Window 250 may be formed in casing string 110 before casing string 110 is installed in main wellbore 114*a*. In other embodiments, the drill bit may be deflected by whipstock 220 into the sidewall of casing string 110 such that it drills through the sidewall of casing string 110 and the sidewall of main wellbore 114*a* into formation 112 to form lateral wellbore 114*b*.

After lateral wellbore 114*b* has been formed, whipstock 220 may be removed from main wellbore 114*a*. To avoid the time and expense associated with inserting a retrieval tool into main wellbore 114*a* to extract whipstock 220 from main wellbore 114*a*, whipstock 220 may be degradable. Thus, whipstock 220 may be removed from main wellbore 114*a* by a chemical reaction that causes whipstock 220 to degrade within main wellbore 114*a*. The term "degrade" may be used to describe a process by which a component breaks down into pieces or dissolves into particles small enough that they do not impede the flow of fluids or movement of downhole tools within main wellbore 114*a* and lateral wellbore 114*b*. The features of whipstock 220, including its degradability, are described in additional detail with respect to FIGS. 3A and 3B.

Figure 3A:
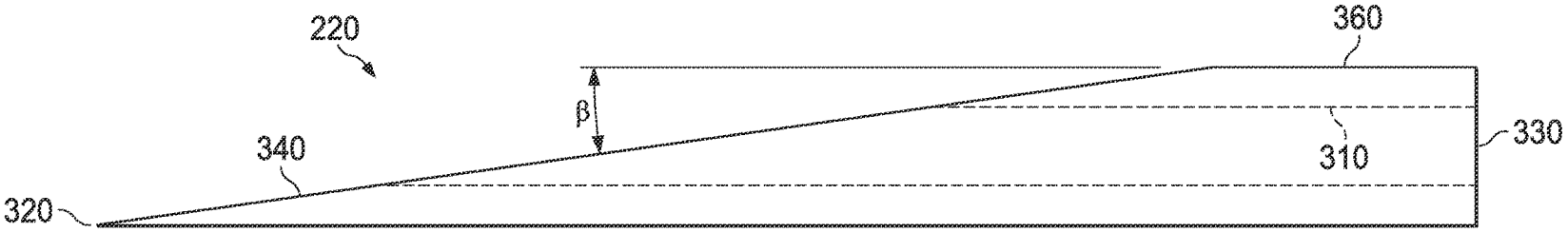
FIG. 3A is a side view of a whipstock.
Figure 3B:
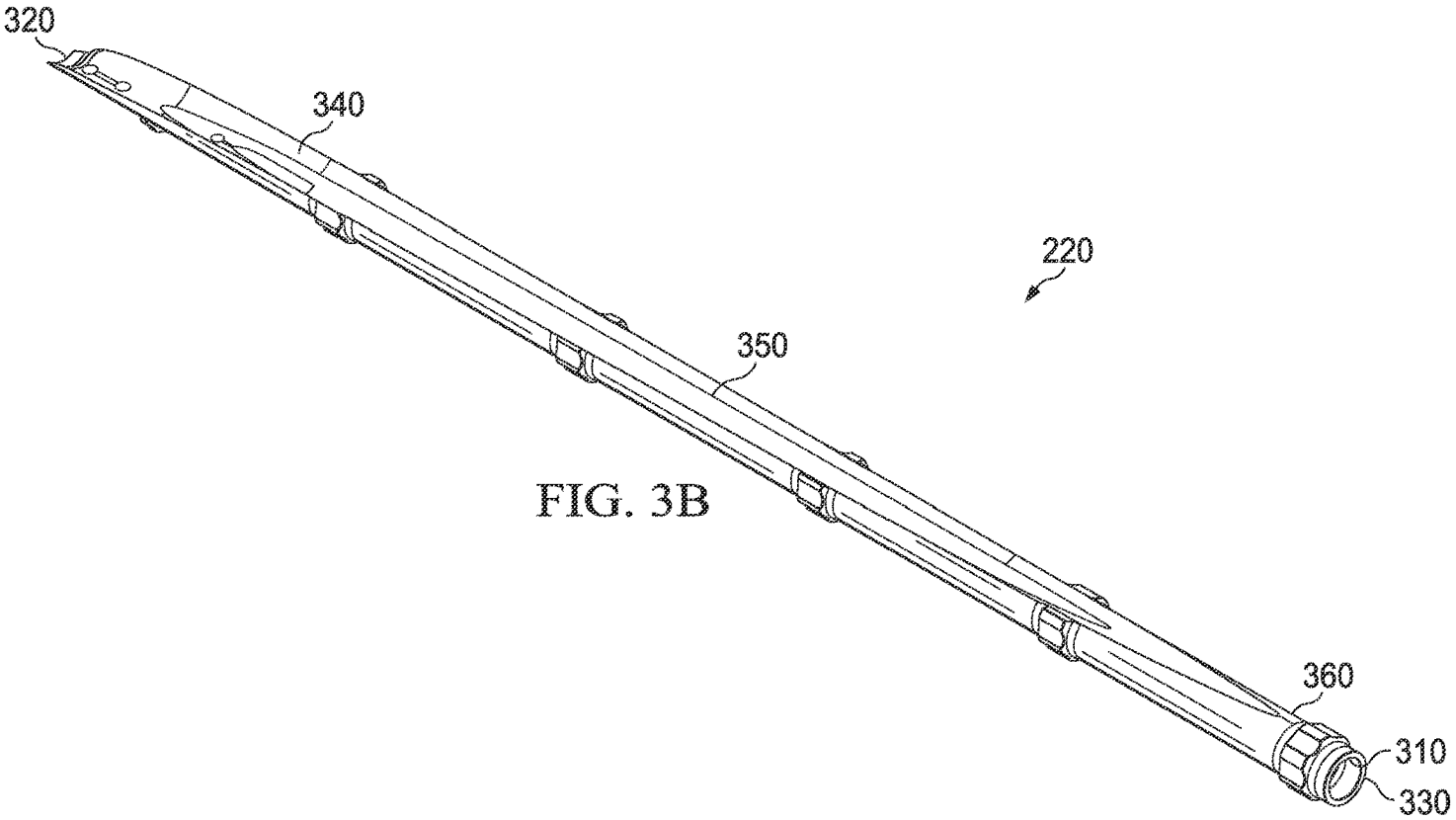
FIG. 3B is an isometric view of a whipstock.

FIG. 3A is a side view of a whipstock and FIG. 3B is an isometric view of a whipstock. As shown in FIG. 3B, whipstock 220 may include channel 310 extending axially through whipstock 220 and open at both leading edge 320 and base 330 of whipstock 220. Channel 310 extending axially through whipstock 220 may be cylindrical, as shown in FIGS. 3A and 3B, or may be any other shape. Channel 310 may be sized to permit fluids circulating within main wellbore 114*a* (shown in FIGS. 1 and 2) to pass through whipstock 220, but to prevent downhole tools inserted into main wellbore 114*a* from passing through or becoming lodged in channel 310.

Whipstock 220 may include an elongated deflection face 340 that extends from leading edge 320 at an angle β from the longitudinal axis of whipstock 220. A drill bit inserted into the wellbore may contact deflection face 340 and be deflected laterally into the sidewall of main wellbore 114*a* (shown in FIGS. 1 and 2) causing the drill bit to drill through the sidewall of casing string 110 (shown in FIGS. 1 and 2) and/or the main wellbore 114*a* and into formation 112 (shown in FIGS. 1 and 2) to form lateral wellbore 114*b* (shown in FIGS. 1 and 2). For example, as discussed above with respect to FIG. 2, in some embodiments, the drill bit may be deflected through window 250 in casing string 110 such that it drills through the sidewall of main wellbore 114*a* into formation 112 to form lateral wellbore 114*b*. In other embodiments, the drill bit may be deflected into the sidewall of casing string 110 such that it drills through the sidewall of casing string 110 and main wellbore 114*a* into formation 112 to form lateral wellbore 114*b*.

Deflection face 340 may be significantly harder than casing string 110 so that, when a drill bit contacts deflection face 340 it will take the path of least resistance by drilling through casing string 110 instead of through deflection face 340. As an example, casing string 110 may have a hardness between approximately 20-30 HRC, while deflection face 340 may have a hardness between approximately 50-60 HRC.

In some embodiments, as shown in FIGS. 3A and 3B, deflection face 340 may extend from leading edge 320 to a point uphole from base 330 such that a continuous cylindrical section 360 of whipstock 220 extends from the downhole end of deflection face 340 to base 330. In other embodiments, deflection face 340 may extend from leading edge 320 to base 330. Deflection face 340 may have any profile suitable for guiding and deflecting a drill bit into the sidewall of casting string 110 and/or main wellbore 114*a* and into formation 112. For example, in some embodiments, as shown in FIG. 3B, deflection face 340 may be a concave surface with v-shaped trough 350 extending axially along the surface and open to channel 310. In other embodiments, deflection face 340 may be a concave surface without a v-shaped trough. In still other embodiments, deflection surface 340 may be a planar surface.

The angle β at which deflection face 340 extends from leading edge 320 may vary depending on the desired path of the drill bit through the sidewall of casing string 110 and/or main wellbore 114*a* and into formation 112. For example, angle β may be chosen such that the drill bit is deflected laterally into the sidewall of casing string 110 and/or main wellbore 114*a* at a particular angle relative to the sidewall of main wellbore 14*a*. The angle at which the drill bit is deflected laterally into the sidewall of casing string 110 and/or main wellbore 114*a* may be substantially equal to angle β. In some embodiments, angle β may be between approximately 1° and 15° from the longitudinal axis of whipstock 220. In other embodiments, angle β may be between approximately 15° and 45° from the longitudinal axis of whipstock 220.

As discussed above with respect to FIG. 2, after lateral wellbore 114*b* has been formed, whipstock 220 may be removed from main wellbore 114*a* using a chemical reaction that causes whipstock 220 to degrade within main wellbore 114*a*, thereby avoiding the intervention required to extract whipstock 220 from main wellbore 114*a* using a retrieval tool. Whipstock 220 may be formed of a degradable composition including a metal or alloy that is reactive under defined conditions. The composition of whipstock 220 may be selected such that whipstock 220 begins to degrade within a predetermined time of first exposure to a corrosive or acidic fluid due to reaction of the metal or alloy with the corrosive or acidic fluid. Alternatively or in addition, the composition of whipstock 220 may be selected such that whipstock 220 is degraded sufficiently within a predetermined time of first exposure to a corrosive or acidic fluid to form pieces or particles small enough that they do not impede the flow of fluids or movement of downhole tools within main wellbore 114*a* and lateral wellbore 114*b*. The corrosive or acidic fluid may already be present within main wellbore 114*a* during drilling operations or may be injected into main wellbore 114*a* to trigger a chemical reaction that causes whipstock 220 to degrade. Exemplary compositions from which whipstock 220 may be formed include compositions in which the metal or alloy is selected from one of calcium, magnesium, aluminum, and combinations thereof.

Whipstock 220 may include a coating to temporarily protect the metal or alloy from exposure to the corrosive or acidic fluid. As an example, whipstock 220 may be coated with a material that melts when a threshold temperature is reached in main wellbore 114*a*. After the coating melts, the surface of whipstock 220 may be exposed to the corrosive or acidic fluid circulating in main wellbore 114*a*. As another example, whipstock 220 may be coated with a material that fractures when exposed to a threshold pressure. The threshold pressure may be a pressure greater than a pressure that occurs during drilling operations. The pressure in main wellbore 114*a* may be manipulated such that it exceeds the threshold pressure, causing the coating to fracture. When the coating fractures, the surface of whipstock 220 may be exposed to the corrosive or acidic fluid circulating in main wellbore 114*a*. Exemplary coatings may be selected from a metallic, ceramic, or polymeric material, and combinations thereof. The coating may have low reactivity with the corrosive or acidic fluid present in main wellbore 114*a*, such that it protects the metal or alloy from degradation until the coating is compromised allowing the corrosive or acidic fluid to contact the metal or alloy.

Whipstock 220 may also be formed from the metal or alloy imbedded with small particles (e.g., particulates, powders, flakes, fibers, and the like) of a non-reactive material. The non-reactive material may be selected such that it remains structurally intact even when exposed to the corrosive or acidic fluid for a duration of time sufficient to degrade the metal or alloy into pieces or particles small enough that they do not impede the flow of fluids or movement of downhole tools within main wellbore 114*a* and lateral wellbore 114*b*. When the metal or alloy degrades, the small particles of the non-reactive material may remain. The particle size of the non-reactive material may be selected such that the particles are small enough that they do not impede the flow of fluids or movement of downhole tools within main wellbore 114*a* and lateral wellbore 114*b*. The non-reactive material may be selected from one of lithium, bismuth, calcium, magnesium, and aluminum (including aluminum alloys) if not already selected as the reactive metal or alloy, and combinations thereof.

Once the chemical reaction causing whipstock 220 to degrade has been triggered, the reaction may continue until whipstock 220 breaks down into pieces or dissolves into particles small enough that they do not impede the flow of fluids or movement of downhole tools within main wellbore 114*a* and lateral wellbore 114*b*. When whipstock 220 has degraded to this point, a downhole tool inserted into main wellbore 114*a* will contact completion deflector 230, instead of whipstock 220, and be deflected into lateral wellbore 114*b*.

Figure 4:
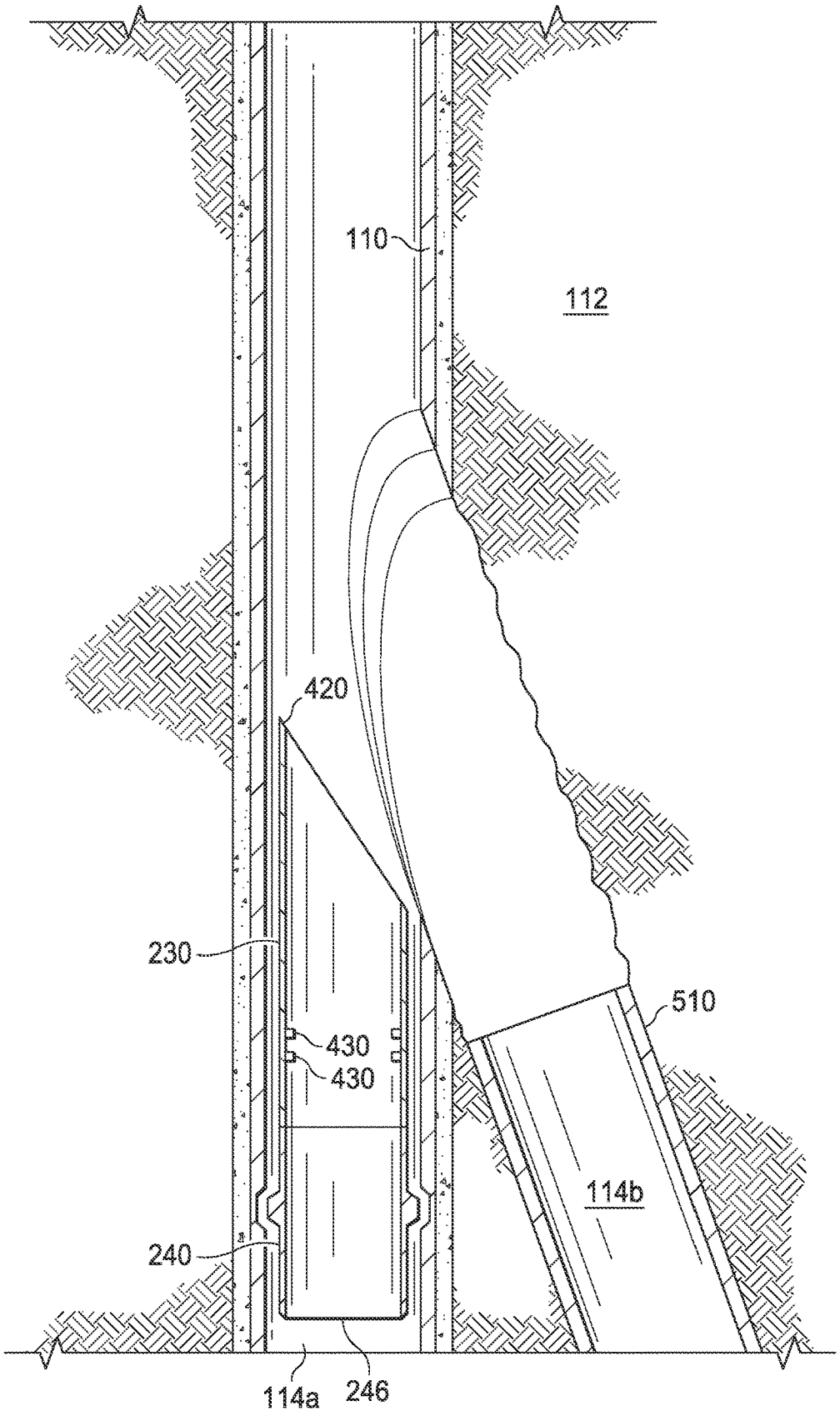
FIG. 4 is a cross-sectional view of a completion deflector and anchoring device installed in a main wellbore from which a lateral wellbore has been formed.

FIG. 4 is a cross-sectional view of a completion deflector and anchoring device installed in a main wellbore from which a lateral wellbore has been formed. After whipstock 220 has degraded within main wellbore 114*a*, completion deflector 230 may be used to deflect downhole tools, liners, and casing string components inserted into lateral wellbore 114*b*. For example, liner 510 may be inserted into main wellbore 114*a*. Liner 510 may contact completion deflector 230 and be deflected into lateral wellbore 114*b*. As shown in FIG. 4, liner 510 may extend downhole into lateral wellbore 114*b* from a point downhole from the intersection between main wellbore 114*a* and lateral wellbore 114*b* to a selected downhole location within lateral wellbore 114*b*. As another example, a lateral casing string may be inserted into main wellbore 14*a*. The lateral casing string may contact completion deflector 230 and be deflected into lateral wellbore 114*b*. The lateral casing string may be held in place by cement, which may be injected between the lateral casing string and the sidewalls of lateral wellbore 114*b*. As still another example, downhole tools for use in lateral wellbore 114*b*, such as, for example, sand control screens, and flow control tools, may be inserted into main wellbore 114*a* and deflected by completion deflector 230 into lateral wellbore 114*b*.

Figure 5A:
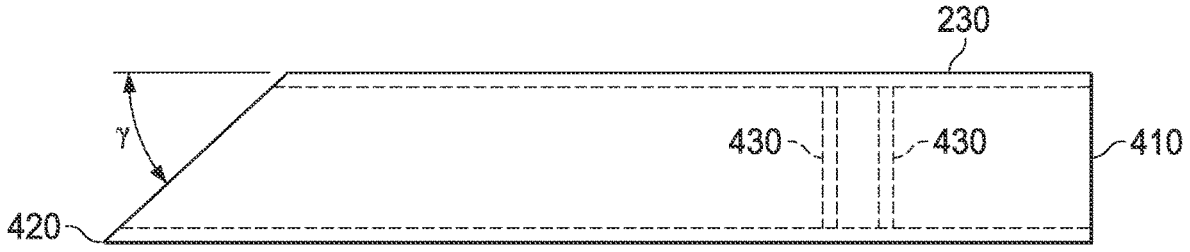
FIG. 5A is a side view of a completion deflector.
Figure 5B:
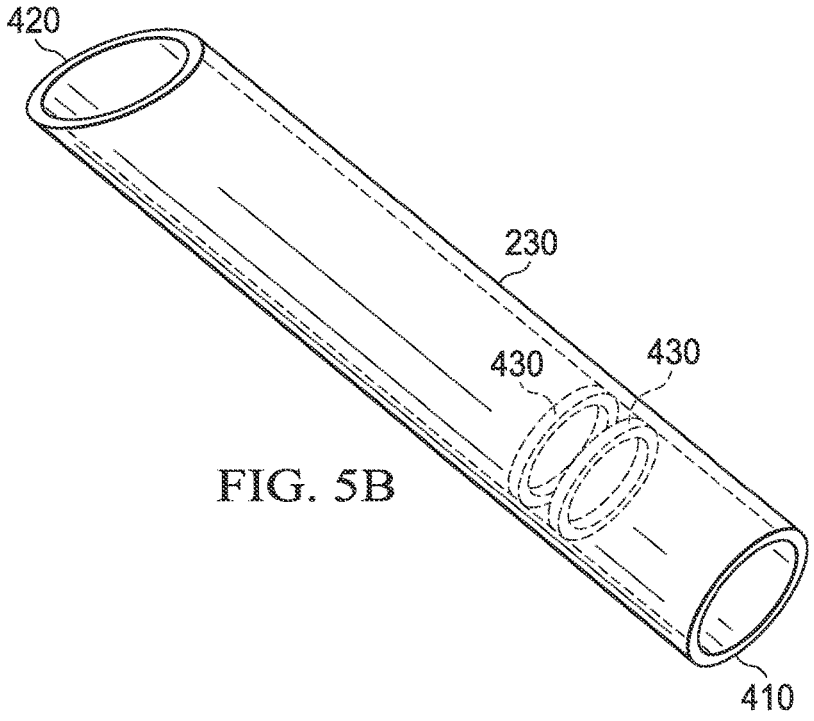
FIG. 5B is an isometric view of a completion deflector.

FIG. 5A is a side view of a completion deflector and FIG. 5B is an isometric view of a completion deflector. Completion deflector 230 may include deflection face 420 that extends from the uphole edge of completion deflector 230 at an angle $\gamma$ from the longitudinal axis of completion deflector 230. The angle $\gamma$ at which deflection face 420 extends from the uphole edge of completion deflector 230 may be substantially equal to the angle $\alpha$ at which lateral wellbore 114*b* extends from main wellbore 114*a* (shown in FIGS. 2 and 4).

Completion deflector 230 may also include channel 410 extending axially through completion deflector 230 to permit fluids circulating within main wellbore 114*a* (shown in FIGS. 2 and 4) to pass through completion deflector 230. Channel 410 may be sized to prevent downhole tools inserted in main wellbore 114*a* from passing through or becoming lodged within channel 410. Downhole tools, liners, and casing strings inserted into main wellbore 114*a* (shown in FIGS. 2 and 4) may contact deflection face 420 of completion deflector 230 and be deflected into lateral wellbore 114*b* (shown in FIGS. 2 and 4).

Figure 6A:
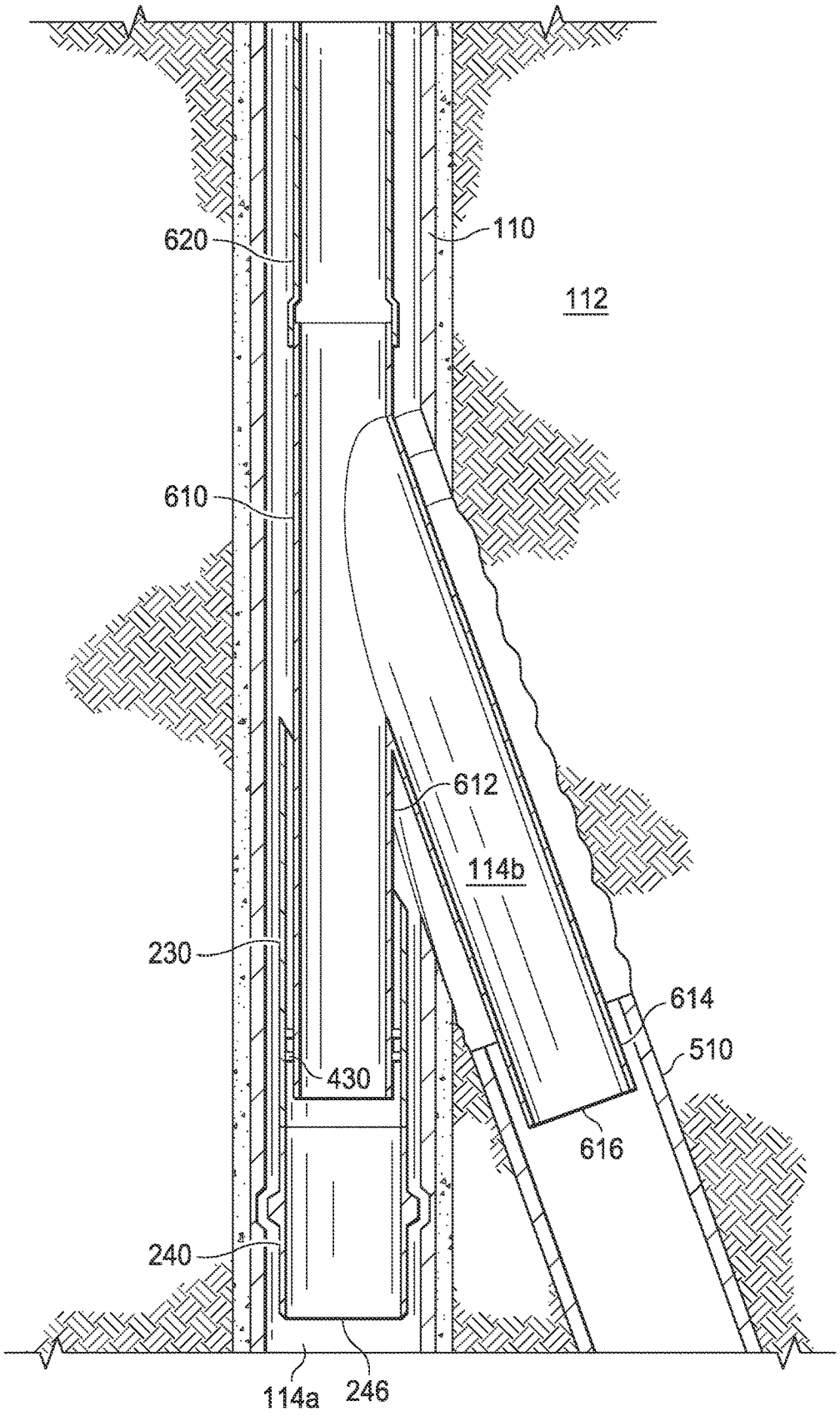
FIG. 6A is a cross-sectional view of a completion deflector and anchoring device installed in a main wellbore and a junction installed in a main wellbore and lateral wellbore.
Figure 6B:
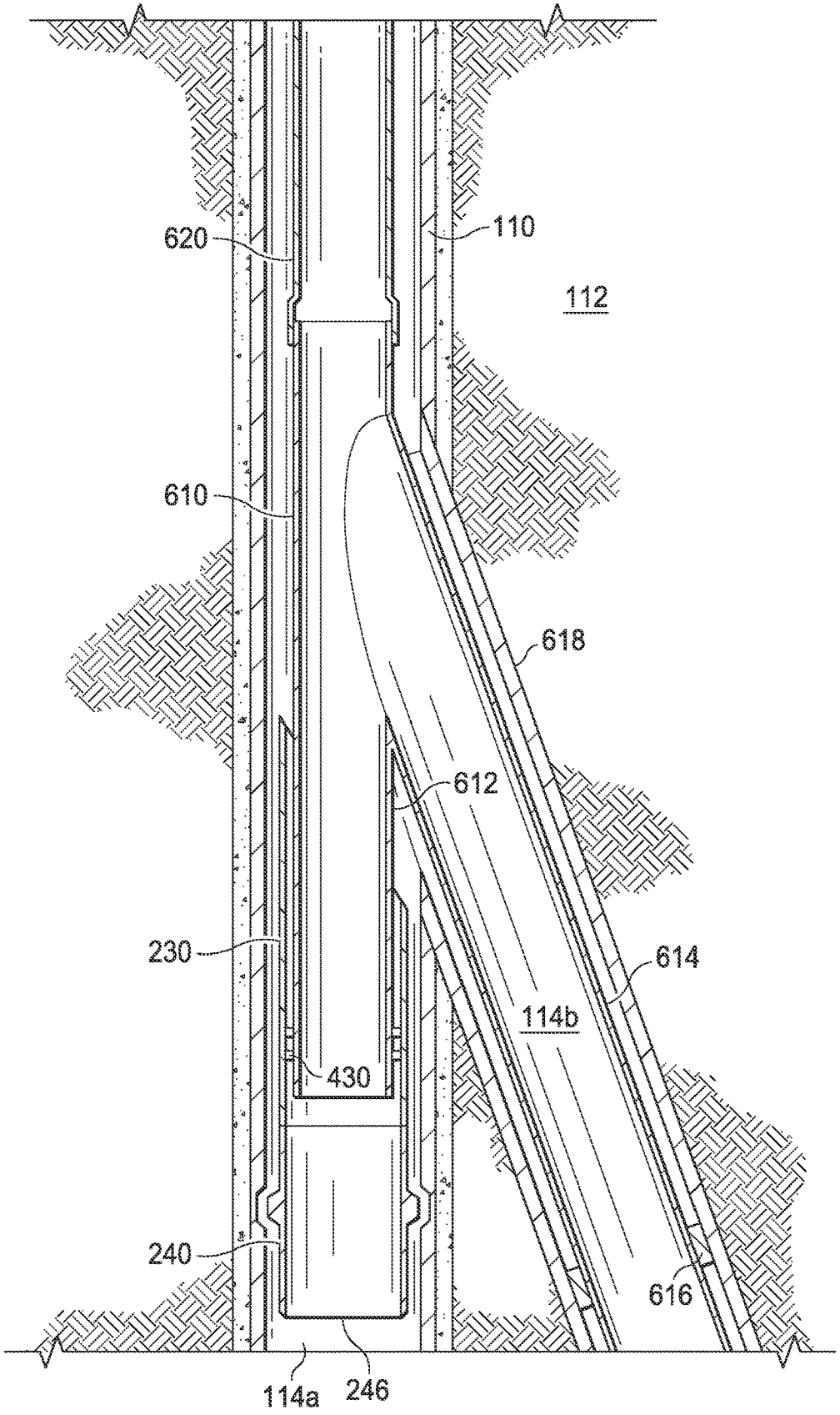
FIG. 6B is a cross-sectional view of a completion deflector and anchoring device installed in a main wellbore and a junction installed in a main wellbore and lateral wellbore.

Completion deflector 230 may also include seals 430 disposed on the inner surface of channel 410. Although two seals 430 are depicted in FIGS. 5A and 5B, any number of seals 430 may be used. In some embodiments, seals 430 may be a molded seal made of an elastomeric material. The elastomeric material may be compounds including, but not limited to, natural rubber, nitrile rubber, hydrogenated nitrile, urethane, polyurethane, fluorocarbon, perflurocarbon, propylene, neoprene, hydrin, etc. Seals 430 may engage with the outer surface of main branch 612 of junction 610 (shown in FIG. 6) to form a fluid and pressure tight seal. FIGS. 6A and 6B are cross-sectional views of a completion deflector and anchoring device installed in a main wellbore and a junction installed in at the intersection of a main wellbore and lateral wellbore. Junction 610 may be installed at the intersection of main wellbore 114*a* and lateral wellbore 114*b* in order to seal and maintain pressure in main wellbore 114*a* and lateral wellbore 114*b*. As shown in FIGS. 6A and 6B, the uphole end of junction 610 may engage with production tubing 620 that extends uphole of junction 610 in main wellbore 114*a*. Junction 610 may engage with production tubing 620 to form a fluid and pressure tight seal. The downhole end of junction 610 may include two branches-a main branch 612 and a lateral branch 614. As shown in FIGS. 6A and 6B, main branch 612 may extend into main wellbore 114*a* downhole from the intersection with lateral wellbore 114*b* and engage with completion deflector 230 to form a fluid and pressure tight seal. For example, main branch 612 of junction 610 may extend into channel 410 (shown in FIGS. 5A and 5B) extending axially through completion deflector 230. The outer surface of main branch 612 may engage seals 430 of completion deflector 230 to form a fluid and pressure tight seal.

As shown in FIG. 6A, lateral branch 614 may extend into lateral wellbore 114*b* and may engage with liner 510 to form a fluid and pressure tight seal. Alternatively, as shown in FIG. 6B, lateral branch 614 may extend into lateral wellbore 114*b* and may engage with lateral casing string 618 to form a fluid and pressure tight seal. In some embodiments, lateral branch 614 may include swell packer 616 that engages with lateral casing string 618 to form a fluid and pressure tight seal. In other embodiments, an alternative sealing mechanism may be used. Once junction 610 is installed and engaged with both completion deflector 230 and liner 510 (as shown in FIG. 6A) or lateral casing string 618 (as shown in FIG. 6B), a fluid and pressure tight seal may be maintained with both main wellbore 114*a* and lateral wellbore 114*b*.

Figure 7:
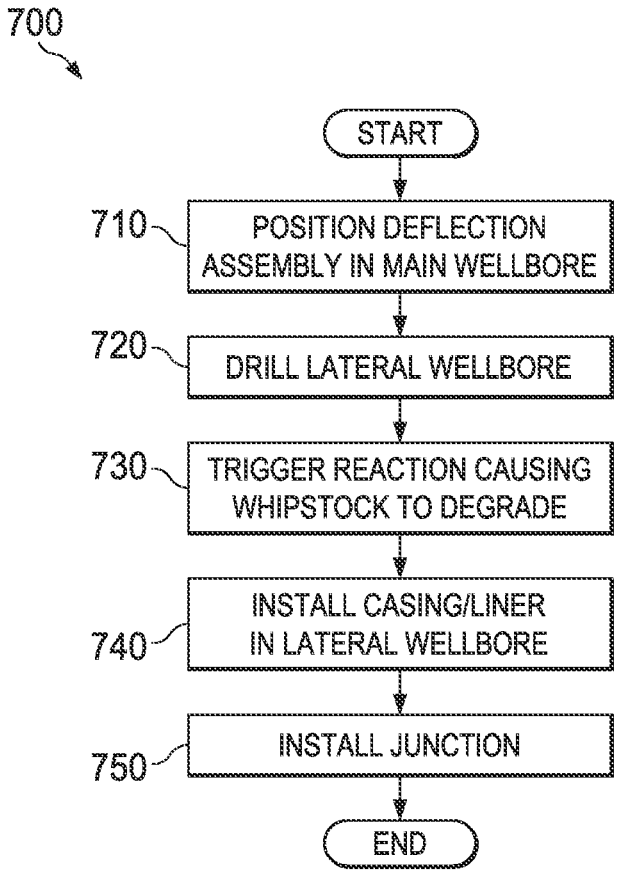
FIG. 7 is a flow-chart of a method of drilling a lateral wellbore.

FIG. 7 is a flow-chart of a method of forming a lateral wellbore. Method 700 may begin, and at step 710, a deflection assembly may be positioned in a main wellbore. The downhole end of the deflection assembly may engage with production tubing or a casing string within the main wellbore to form a fluid and pressure tight seal. As discussed above with respect to FIGS. 1 and 2, the deflection assembly may be positioned within the main wellbore at a desired intersection with a lateral wellbore. For example, the deflection assembly may be positioned in the main wellbore such that a drill bit inserted into the main wellbore contacts the deflection assembly and is deflected laterally into the sidewall of the main wellbore at the desired intersection with the lateral wellbore. The positioning of the deflection assembly may be determined based on the desired elevation of the intersection with the lateral wellbore and the desired angle $\alpha$ (shown in FIG. 2) of the lateral wellbore relative to the main wellbore.

The deflection assembly may include an anchoring device that holds the deflection assembly in place within the main wellbore. The anchoring device may include spring-loaded latches configured to engage with recesses formed on the interior surface of a casing string within the main wellbore. When the deflection assembly is inserted into the main wellbore and the latches of the deflection assembly are aligned with the recesses in the casing string, the latches may extend radially into the recesses and anchor the deflection assembly within the casing string. Alternatively, the anchoring device may include spring-loaded, serrated dogs configured to engage with the interior surface of a casing string within the main wellbore. When the deflection assembly is inserted into the main wellbore, the serrated dogs may extend radially to engage with the interior surface of the casing string.

At step 720, a lateral wellbore may be drilled. As discussed above with respect to FIGS. 2, 3A, and 3B, the deflection assembly may be used to assist with drilling a lateral wellbore. For example, the uphole end of the deflection assembly may include a whipstock with an elongated deflection face extending at an angle from the uphole end of the whipstock. A drill bit inserted into the main wellbore may contact the deflection face of the whipstock and be deflected laterally into the sidewall of the main wellbore, causing the drill bit to drill through the sidewall of the main wellbore and into the formation to form a lateral wellbore. As discussed above with respect to FIGS. 3A and 3B, the elongated deflection face of the whipstock may be significantly harder than the casing string of the main wellbore so that, when a drill bit contacts the deflection face it will take the path of least resistance by drilling through the casing string instead of through the deflection face. The angle at which the deflection face extends from the uphole end of the whipstock may vary depending on the desired path of the drill bit through the sidewall of the main wellbore and into the formation. For example, as discussed above with respect to FIG. 3A, the angle may be chosen such that the drill bit is deflected laterally into the sidewall of the main wellbore at a particular angle relative to the main wellbore.

After the lateral wellbore has been formed, the method may proceed to step 730. At step 730, a chemical reaction may be triggered that causes the whipstock to degrade. As discussed above with respect to FIGS. 3A and 3B, the whipstock may be formed of a degradable composition including a metal or alloy that is reactive under defined conditions. The composition of the whipstock may be selected such that the whipstock begins to degrade within a predetermined time of first exposure to a corrosive or acidic fluid due to reaction of the metal or alloy with the corrosive or acidic fluid. Alternatively or in addition, the composition of the whipstock may be selected such that the whipstock is degraded sufficiently within a predetermined time of first exposure to a corrosive or acidic fluid to form pieces or particles small enough that they do not impede the flow of fluids or movement of downhole tools within the main wellbore and the lateral wellbore. The corrosive or acidic fluid may already be present within the main wellbore during drilling operations or may be injected into the main wellbore to trigger a chemical reaction that causes the whipstock to degrade. Thus, the chemical reaction may be triggered when the amount of time the whipstock has been exposed to the corrosive or acidic fluid exceeds a threshold time.

Additionally, as discussed above with respect to FIGS. 3A and 3B, the whipstock may include a coating to temporarily protect the metal or alloy from exposure to the corrosive or acidic fluid. As an example, the whipstock may be coated with a material that melts when a threshold temperature is reached in the main wellbore. After the coating melts, the surface of the whipstock may be exposed to the corrosive or acidic fluid circulating in main wellbore. As another example, the whipstock may be coated with a material that fractures when exposed to a threshold pressure. The pressure in the main wellbore may be manipulated such that it exceeds the threshold pressure, causing the coating to fracture. When the coating fractures, the surface of the whipstock may be exposed to the corrosive or acidic fluid circulating in the main wellbore.

As discussed with respect to FIGS. 3A and 3B, the whipstock may also be formed from the metal or alloy imbedded with small particles (e.g., particulates, powders, flakes, fibers, and the like) of a non-reactive material. The non-reactive material may be selected such that it remains structurally intact even when exposed to the corrosive or acidic fluid for a duration of time sufficient to degrade the metal or alloy into pieces or particles small enough that they do not impede the flow of fluids or movement of downhole tools within the main wellbore and lateral wellbore. When the metal or alloy degrades, the small particles of the non-reactive material may remain. The particle size of the non-reactive material may be selected such that the particles are small enough that they do not impede the flow of fluids or movement of downhole tools within the main wellbore and lateral wellbore.

Once the chemical reaction causing the whipstock to degrade has been triggered, the reaction may continue until the whipstock breaks down into pieces or dissolves into particles small enough that they do not impede the flow of fluids or movement of downhole tools within the main wellbore and the lateral wellbore.

At step 740, a liner or casing string may be installed in the lateral wellbore. As discussed above with respect to FIG. 4, when the whipstock degrades, it may expose a completion deflector of the deflection assembly, which may be used to deflect downhole tools, liners, and casing string components inserted in the main wellbore into the lateral wellbore. When a liner or lateral casing string is inserted into the main wellbore, it may contact the completion deflector and be deflected into the lateral wellbore.

At step 750, a junction may be installed to seal and maintain pressure in the main wellbore and the lateral wellbore. As discussed above with respect to FIG. 6, the junction may be installed at the intersection of the main wellbore and the lateral wellbore. As shown in FIGS. 6A and 6B, the uphole end of the junction may engage with production tubing that extends uphole within main wellbore to form a fluid and pressure tight seal. The downhole end of the junction may include two branches-a main branch and a lateral branch. The main branch may extend into the main wellbore downhole from the intersection with the lateral wellbore and may engage with the completion deflector to firm a fluid and pressure tight seal. As shown in FIG. 6A, the lateral branch may extend into the lateral wellbore and engage with a liner in the lateral wellbore to form a fluid and pressure tight seal. Alternatively, as shown in FIG. 6B, the lateral branch may extend into the lateral wellbore and engage with a lateral casing string to form a fluid and pressure tight seal. Once the junction is installed and engaged with both the completion deflector and the liner or lateral casing string, a fluid and pressure tight seal may be maintained in both the main wellbore and the lateral wellbore.

Modifications, additions, or omissions may be made to method 700 without departing from the scope of the present disclosure. For example, the order of the steps may be performed in a different manner than that described and some steps may be performed at the same time. Additionally, each individual step may include additional steps without departing from the scope of the present disclosure.

Embodiments disclosed herein include:

A. A wellbore sealing system that includes a deflection assembly positioned in a main wellbore, the deflection assembly including a degradable whipstock configured to laterally deflect a drill bit such that the drill bit drills through a sidewall of the main wellbore to form a lateral wellbore; a completion deflector coupled to and located downhole from the whipstock; and an anchoring device coupled to and located downhole from the completion deflector to form a fluid and pressure tight seal between an uphole end of the anchoring device and the completion deflector, the anchoring device engaged with a casing string in the main wellbore to prevent the deflection assembly from rotating and moving in an uphole direction and a downhole direction within the main wellbore. The sealing system further includes a junction coupled to an uphole end of the completion deflector and engaged with a liner disposed in the lateral wellbore to form a fluid and pressure tight seal.

B. A method of forming a wellbore that includes positioning a deflection assembly in a main wellbore such that the deflection assembly engages with a casing string of the main wellbore to form a fluid and pressure tight seal, the deflection assembly including a degradable whipstock and a completion deflector; inserting a drill bit into the main wellbore such that it contacts the degradable whipstock and is laterally deflected, causing the drill bit to drill through a sidewall of the main wellbore to form a lateral wellbore; triggering a chemical reaction that causes the degradable whipstock to degrade within the main wellbore and expose the completion deflector, and installing a junction at an intersection of the main wellbore and the lateral wellbore such that the junction engages with the completion deflector and a liner disposed in the lateral wellbore to form a fluid and pressure tight seal.

Each of embodiments A, and B may have one or more of the following additional elements in any combination: Element 1: wherein the junction includes an uphole end that engages with production tubing in the main wellbore to form a fluid and pressure tight seal; and a downhole end including a main branch that extends into the main wellbore downhole from an intersection with the lateral wellbore and engages with the completion deflector to form a fluid and pressure tight seal; and a lateral branch that extends into the lateral wellbore and engages with the liner to form a fluid and pressure tight seal.

Element 2: wherein the degradable whipstock comprises a whipstock deflection face configured to laterally deflect a drill bit such that the drill bit drills through a sidewall of the main wellbore to form a lateral wellbore. Element 3: wherein the completion deflector comprises a deflection face extending at an angle from the uphole edge of the completion deflector such that a downhole tool that contacts the second deflection face is deflected laterally into the lateral wellbore. Element 4: wherein the completion deflector comprises a channel extending axially there through and configured permit fluids circulating within the main wellbore to pass through the completion deflector, but prevent downhole tools with a diameter greater than a diameter of the channel from passing through or lodging within the channel. Element 5: wherein the anchoring device further comprises a plurality of spring-loaded latches that engage with a plurality of recesses formed on an interior surface of the casing string to prevent the deflection assembly from rotating and moving in the uphole direction and the downhole direction within the main wellbore. Element 6: wherein the anchoring device further comprises a plurality of serrated dogs that engage with an interior surface of the casing string to prevent the deflection assembly from rotating and moving in the uphole direction and the downhole direction within the main wellbore. Element 7: wherein the degradable whipstock is formed of a composition that degrades within the main wellbore within a predetermined time of first exposure to a fluid in the main wellbore. Element 8: wherein the degradable whipstock includes a whipstock formed of a composition that degrades within the main wellbore upon exposure to a first fluid in the main wellbore; and a protective coating formed around the whipstock that temporarily protects the whipstock from exposure to the first fluid. Element 9: wherein the protective coating melts when a threshold temperature is reached in the main wellbore, thereby exposing the whipstock to the first fluid. Element 10: wherein the protective coating fractures when a threshold pressure is reached in the main wellbore, thereby exposing the whipstock to the first fluid. Element 11: wherein the protective coating fractures when a threshold pressure is reached in the main wellbore, thereby exposing the whipstock to the first fluid. Element 12: wherein positioning the deflection assembly in the main wellbore comprises anchoring the deflection assembly within the main wellbore using an anchoring device including a plurality of spring-loaded latches that engage with a plurality of recesses formed on an interior surface of the casing string to prevent the deflection assembly from rotating and moving in an uphole direction and a downhole direction within the main wellbore. Element 13: wherein positioning the deflection assembly in the main wellbore comprises anchoring the deflection assembly within the main wellbore using an anchoring device including a plurality of serrated dogs that engage with an interior surface of the casing string to prevent the deflection assembly from rotating and moving in the uphole direction and the downhole direction within the main wellbore. Element 14: wherein the chemical reaction is triggered by exposure of the degradable whipstock to a fluid in the main wellbore for an amount of time exceeding a threshold time. Element 15: wherein triggering the chemical reaction comprises removing a protective coating of the degradable whipstock to expose the degradable whipstock to a first fluid in the main wellbore. Element 16: wherein removing the protective coating comprises exposing the protective coating to a second fluid in the main wellbore, thereby exposing the degradable whipstock to the first fluid. Element 17: wherein removing the protective coating comprises exposing the whipstock to a threshold temperature that causes the protective coating to melt. Element 178: wherein removing the protective coating comprises exposing the whipstock to a threshold pressure that causes the protective coating to fracture. Element 19: wherein the whipstock degrades into particles small enough that they do not impede fluid flow or movement of downhole tools within the main wellbore and the lateral wellbore.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A wellbore sealing system comprising:

a deflection assembly positioned in a main wellbore, the deflection assembly comprising:

a degradable whipstock configured to laterally deflect a drill bit such that the drill bit drills through a sidewall of the main wellbore to form a lateral wellbore;

a completion deflector coupled to and located downhole from the degradable whipstock, the completion deflector including a deflection face having a downhole end located uphole of an intersection between the main wellbore and the lateral wellbore, the completion deflector configured to position a downhole tool in the lateral wellbore when the degradable whipstock has degraded; and an anchoring device coupled to and located downhole from the completion deflector to prevent the deflection assembly from rotating and moving in an uphole direction and a downhole direction within the main wellbore; and a junction coupled to an uphole end of the completion deflector and extending into the lateral wellbore to form a fluid and pressure tight seal.

2. The wellbore sealing system of claim 1, wherein the junction comprises:

an uphole end that engages with a production tubing in the main wellbore to form a fluid and pressure tight seal; and a downhole end including:

a main branch that extends into the main wellbore downhole from an intersection with the lateral wellbore and engages with the completion deflector to form a fluid and pressure tight seal; and a lateral branch that extends into the lateral wellbore and engages with a liner disposed in the lateral wellbore to form the fluid and pressure tight seal.

3. The wellbore sealing system of claim 1, wherein the degradable whipstock comprises a whipstock deflection face configured to laterally deflect the drill bit such that the drill bit drills through the sidewall of the main wellbore to form the lateral wellbore.

4. The wellbore sealing system of claim 1, wherein the deflection face of the completion deflector extends at an angle from an uphole edge of the completion deflector such that a downhole tool that contacts the deflection face is deflected laterally into the lateral wellbore.

5. The wellbore sealing system of claim 1, wherein the completion deflector comprises a channel extending axially there through and configured to permit fluids circulating within the main wellbore to pass through the completion deflector, but prevent a downhole tool with a diameter greater than a diameter of the channel from passing through or lodging within the channel.

6. The wellbore sealing system of claim 1, wherein the anchoring device further comprises a plurality of spring-loaded latches that engage with a plurality of recesses formed on an interior surface of a casing string positioned in the main wellbore to prevent the deflection assembly from rotating and moving in the uphole direction and the downhole direction within the main wellbore.

7. The wellbore sealing system of claim 1, wherein the anchoring device further comprises a plurality of serrated dogs that engage with an interior surface of a casing string positioned in the main wellbore to prevent the deflection assembly from rotating and moving in the uphole direction and the downhole direction within the main wellbore.

8. The wellbore sealing system of claim 1, wherein the degradable whipstock is formed of a composition that degrades within the main wellbore within a predetermined time of first exposure to a fluid in the main wellbore.

9. The wellbore sealing system of claim 1, wherein the degradable whipstock comprises:

a whipstock formed of a composition that degrades within the main wellbore upon exposure to a first fluid in the main wellbore; and a protective coating formed around the whipstock that temporarily protects the whipstock from exposure to the first fluid.

10. The wellbore sealing system of claim 9, wherein the protective coating melts at a threshold temperature to expose the whipstock to the first fluid.

11. The wellbore sealing system of claim 9, wherein the protective coating degrades upon exposure to a second fluid to expose the whipstock to the first fluid.

12. The wellbore sealing system of claim 9, wherein the protective coating fractures at a threshold pressure to expose the whipstock to the first fluid.

13. A method of forming a wellbore, comprising:

positioning a deflection assembly in a main wellbore such that the deflection assembly engages with a production tubing in the main wellbore to form a fluid and pressure tight seal, the deflection assembly including a degradable whipstock and a completion deflector configured to position a downhole tool in a lateral wellbore when the degradable whipstock has degraded, the completion deflector including a deflection face having a downhole end located uphole of an intersection between the main wellbore and the lateral wellbore;

inserting a drill bit into the main wellbore such that it contacts the degradable whipstock and is laterally deflected, causing the drill bit to drill through a sidewall of the main wellbore to form the lateral wellbore;

triggering a chemical reaction that causes the degradable whipstock to degrade within the main wellbore and expose the completion deflector; and installing a junction at the intersection of the main wellbore and the lateral wellbore such that the junction engages with the completion deflector and extends into the lateral wellbore to form a fluid and pressure tight seal.

14. The method of claim 13, wherein positioning the deflection assembly in the main wellbore comprises anchoring the deflection assembly within the main wellbore using an anchoring device including a plurality of spring-loaded latches that engage with a plurality of recesses formed on an interior surface of a casing string positioned in the main wellbore to prevent the deflection assembly from rotating and moving in an uphole direction and a downhole direction within the main wellbore.

15. The method of claim 13, wherein positioning the deflection assembly in the main wellbore comprises anchoring the deflection assembly within the main wellbore using an anchoring device including a plurality of serrated dogs that engage with an interior surface of a casing string positioned in the main wellbore to prevent the deflection assembly from rotating and moving in the uphole direction and the downhole direction within the main wellbore.

16. The method of claim 13, wherein the degradable whipstock comprises a whipstock deflection face configured to laterally deflect the drill bit such that the drill bit drills through the sidewall of the main wellbore to form the lateral wellbore.

17. The method of claim 13, wherein the junction comprises:

an uphole end that engages with the production tubing in the main wellbore to form a fluid and pressure tight seal; and a downhole end including:

a main branch that extends into the main wellbore downhole from the intersection with the lateral wellbore and engages with the completion deflector to form a fluid and pressure tight seal; and a lateral branch that extends into the lateral wellbore and engages with a liner disposed in the lateral wellbore to form the fluid and pressure tight seal.

18. The method of claim 13, wherein the completion deflector comprises a channel extending axially there through and configured to permit fluids circulating within the main wellbore to pass through the completion deflector, but prevent a downhole tool with a diameter greater than a diameter of the channel from passing through or lodging within the channel.

19. The method of claim 13, wherein the chemical reaction is triggered by exposure of the degradable whipstock to a fluid in the main wellbore for an amount of time exceeding a threshold time.

20. The method of claim 13, wherein triggering the chemical reaction comprises removing a protective coating of the degradable whipstock to expose the degradable whipstock to a first fluid in the main wellbore.

21. The method of claim 20, wherein removing the protective coating comprises exposing the degradable whipstock to a threshold temperature that causes the protective coating to melt.

22. The method of claim 20, wherein removing the protective coating comprises exposing the degradable whipstock to a threshold pressure that causes the protective coating to fracture.

23. The method of claim 20, wherein removing the protective coating comprises exposing the protective coating to a second fluid in the main wellbore to expose the degradable whipstock to the first fluid.

24. The method of claim 13, wherein the degradable whipstock degrades into particles small enough that they do not impede fluid flow or movement of a downhole tool within the main wellbore and the lateral wellbore.

* * * * *